US011970749B2

(12) United States Patent
Song et al.

(10) Patent No.: US 11,970,749 B2
(45) Date of Patent: Apr. 30, 2024

(54) HOT ROLLED STEEL SHEET HAVING EXCELLENT FORMABILITY AND FATIGUE PROPERTIES AND MANUFACTURING METHOD THEREFOR

(71) Applicant: POSCO CO., LTD, Pohang-si (KR)

(72) Inventors: Tae-Jin Song, Gwangyang-si (KR); Jeong-Eun Kim, Gwangyang-si (KR); Chang-Sik Choi, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 18/171,305

(22) Filed: Feb. 17, 2023

(65) Prior Publication Data

US 2023/0203610 A1 Jun. 29, 2023

Related U.S. Application Data

(62) Division of application No. 16/470,808, filed as application No. PCT/KR2017/014580 on Dec. 12, 2017, now Pat. No. 11,591,664.

(30) Foreign Application Priority Data

Dec. 21, 2016 (KR) ..... 10-2016-0176128

(51) Int. Cl.
*C21D 8/02* (2006.01)
*C21D 9/46* (2006.01)
(Continued)

(52) U.S. Cl.
CPC ..... *C21D 8/0226* (2013.01); *C21D 8/0205* (2013.01); *C21D 8/0215* (2013.01);
(Continued)

(58) Field of Classification Search
CPC .. C21D 8/0226; C21D 8/0205; C21D 8/0215; C21D 8/0247; C21D 9/46;
(Continued)

(56) References Cited

U.S. PATENT DOCUMENTS

2008/0035249 A1 2/2008 Scott et al.
2008/0240969 A1 10/2008 Kim et al.
(Continued)

FOREIGN PATENT DOCUMENTS

JP 04052218 2/1992
JP 07118756 5/1995
(Continued)

OTHER PUBLICATIONS

Barani et al., Clean, flawless and thinner stainless steel valves by strip casting, 2019, IOP Conf. Series: Materials Science and Engineering, vol. 604, pp. 1-10.
(Continued)

*Primary Examiner* — Anthony M Liang
(74) *Attorney, Agent, or Firm* — CANTOR COLBURN LLP

(57) ABSTRACT

Provided is a method of manufacturing a hot rolled steel sheet having excellent formability and fatigue properties, including: preparing a slab including, by weight %, 0.3 to 0.8% of carbon C, 13 to 25% of manganese (Mn), 0.1 to 1.0% of vanadium (V), 0.005 to 2.0% of silicon (Si), 0.01 to 2.5% of aluminum (Al), 0.03% or less of phosphorus (P), 0.03% or less of sulfur (S), 0.04% or less (excluding 0%) of nitrogen (N), and a remainder of iron (Fe) and inevitable impurities; heating the slab to 1050 to 1250° C.; finish rolling, the slab heated in the heating, at a temperature of not lower than a recrystallization temperature of a region having an average V concentration and not higher than a recrystallization temperature of a region having twice the average V concentration, to obtain a hot rolled steel sheet; and coiling the hot-rolled steel sheet at 50 to 700° C.

3 Claims, 8 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.
CPC ..... *C21D 8/0247* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/001* (2013.01)

(58) Field of Classification Search
CPC ..... C21D 2211/001; C22C 38/001; C22C 38/002; C22C 38/02; C22C 38/04; C22C 38/06; C22C 38/12; C22C 38/14
See application file for complete search history.

(56) References Cited

U.S. PATENT DOCUMENTS

| | | | |
|---|---|---|---|
| 2013/0118647 | A1 | 5/2013 | Berkhout et al. |
| 2013/0295409 | A1 | 11/2013 | Chin et al. |

FOREIGN PATENT DOCUMENTS

| | | | | |
|---|---|---|---|---|
| JP | 2008528796 | | 7/2008 | |
| JP | 2010106313 | | 5/2010 | |
| JP | 2013534566 | | 9/2013 | |
| KR | 20070023831 | | 3/2007 | |
| KR | 20090020278 | | 2/2009 | |
| KR | 20090070501 | | 7/2009 | |
| KR | 20090070503 | | 7/2009 | |
| KR | 20090070510 | | 7/2009 | |
| KR | 100957974 | | 5/2010 | |
| KR | 100957975 | | 5/2010 | |
| KR | 20100071619 | | 6/2010 | |
| KR | 20100071619 | A * | 6/2010 | ..... C21D 8/0221 |
| KR | 20130093743 | | 8/2013 | |
| KR | 101360519 | | 2/2014 | |
| KR | 20150075324 | | 7/2015 | |
| KR | 20160078840 | | 7/2016 | |
| WO | 2018104984 | | 6/2018 | |

OTHER PUBLICATIONS

European Search Report—European Application No. 17883011.3 dated Sep. 17, 2019, citing KR 101 360 519, KR 2015 0075324, KR 2010 0071619, US 2008/035249 and KR 2009 0020278.

International Search Report—PCT/KR2017/014580 dated Mar. 13, 2018.

Japanese Office Action—Japanese Application No. 2019-533165 dated Oct. 6, 2020, citing KR 10-2009-0020278, KR 10-2010-0071619, KR 10-2009-0070510, KR 10-2009-0070503, JP 04-052218, JP 07-118756, KR 10-2013-0093743, KR 10-2015-0075324, KR 10-2010-0071619, JP 2008-528796, and JP 2013-534566.

* cited by examiner

HOT ROLLED STEEL SHEET HAVING EXCELLENT FORMABILITY AND FATIGUE PROPERTIES AND MANUFACTURING METHOD THEREFOR

TECHNICAL FIELD

The present disclosure relates to a hot-rolled steel sheet having excellent formability and fatigue properties and a method of manufacturing the same. More particularly, the present disclosure relates to a high manganese steel having excellent formability and fatigue properties, usable for a chassis structural member of an automobile or the like, by press forming.

BACKGROUND ART

In recent years, due to the regulation of carbon dioxide to reduce global warming, there has been strong demand for the lightening of automobiles. At the same time, the strength of automotive steel sheets has been continuously increased to improve the crash stability of automobiles.

Among automobile parts, chassis components such as a lower arm, a wheel disc, and the like are generally used by pickling and oiling a hot-rolled steel sheet. Chassis components are manufactured by cold press forming, and thus, should have excellent formability and also have excellent fatigue properties to prevent fatigue breakage in driving. Since chassis components supporting the vehicle are positioned at the lower end of the center of gravity of the vehicle, the effect of reducing fuel consumption may be significantly high by reducing the weight of components. On the other hand, the fatigue breakage of the chassis components has a disadvantage in that it may be difficult to confirm the progress during use, and may adversely affect the safety of passengers in the case of breakage while driving. Therefore, safety factors should be conservatively applied, and it is ideal to design the safety factors as a fatigue limit or less in a high cyclic fatigue mode applied to automotive structural members. Therefore, if the fatigue limit of a material is improved and the chassis parts may be lightened, an excellent fuel economy reduction effect may be expected.

Generally, low-temperature transformation microstructures are used for producing hot-rolled steel sheets for automobile chassis parts. However, it is difficult to obtain an elongation of 40% or more at a tensile strength of 600 MPa or more in the case of using a low-temperature transformation microstructure to secure high strength and fatigue properties. Thus, in this case, since it is difficult to apply the hot-rolled steel sheet to parts having a complicated shape by cold press forming, there is a difficulty in designing a free part design for a required application.

On the other hand, Patent Document 1 discloses a method, in which a large amount of austenite stabilizing elements such as carbon (C), manganese (Mn) and the like are added to maintain the microstructure as an austenite single phase, and strength and formability are simultaneously secured using twinning generated during deformation. However, only the strength and elongation in the case of the high-manganese steel provided in the related art have been considered, but the improvement of fatigue properties that may guarantee the safety of the automobile, in terms of the characteristics of an automobile member where stress is concentrated for an extended period of time, is not mentioned.

Therefore, it is necessary to develop a steel sheet for automobiles, in which strength and formability are excellent and in which high fatigue strength may be secured.

PRIOR ART DOCUMENT (Patent Document 1) Korean Patent Laid-Open Publication No. 2007-0023831

DISCLOSURE

Technical Problem

An aspect of the present disclosure is to provide a hot-rolled steel sheet having a high tensile strength and excellent elongation and simultaneously having excellent fatigue properties and excellent formability, which may be suitably applied to a chassis structural member of an automobile and the like, and a method of manufacturing the same.

On the other hand, the object of the present disclosure is not limited to the above description. It will be understood by those skilled in the art that there would be no difficulty in understanding the additional object of the present disclosure.

Technical Solution

According to an aspect of the present disclosure, a hot rolled steel sheet having excellent formability and fatigue properties includes, by weight %, 0.3 to 0.8% of carbon C, 13 to 25% of manganese (Mn), 0.1 to 1.0% of vanadium (V), 0.005 to 2.0% of silicon (Si), 0.01 to 2.5% of aluminum (Al), 0.03% or less of phosphorus (P), 0.03% or less of sulfur (S), 0.04% or less (excluding 0%) of nitrogen (N), and a remainder of iron (Fe) and inevitable impurities.

When a cross section of the hot rolled steel sheet is viewed in a thickness direction, the hot rolled steel sheet includes, by area fraction, 20 to 70% of an unrecrystallized microstructure and 30 to 80% of a recrystallized microstructure.

According to another aspect of the present disclosure, a method of manufacturing a hot rolled steel sheet having excellent formability and fatigue properties includes:

preparing a slab including, by weight %, 0.3 to 0.8% of carbon C, 13 to 25% of manganese (Mn), 0.1 to 1.0% of vanadium (V), 0.005 to 2.0% of silicon (Si), 0.01 to 2.5% of aluminum (Al), 0.03% or less of phosphorus (P), 0.03% or less of sulfur (S), 0.04% or less (excluding 0%) of nitrogen (N), and a remainder of iron (Fe) and inevitable impurities;

heating the slab to 1050 to 1250° C.;

finish rolling, the slab heated in the heating, at a temperature of not lower than a recrystallization temperature of a region having an average V concentration and not higher than a recrystallization temperature of a region having twice the average V concentration, to obtain a hot rolled steel sheet; and coiling the hot-rolled steel sheet at 50 to 700° C.

In addition, the solution of the above-mentioned problems does not list all the features of the present disclosure. The various features of the present disclosure and the advantages and effects thereof may be understood in more detail with reference to the following specific embodiments.

Advantageous Effects

According to an embodiment in the present disclosure, a hot-rolled steel sheet having high tensile strength and excellent elongation, excellent fatigue properties and excellent durability, and a method of manufacturing the same, may be provided.

BEST MODE FOR INVENTION

Hereinafter, embodiments of the present disclosure will be described. However, the embodiments of the present disclosure may be modified to have various other forms, and the scope of the present disclosure is not limited to the embodiments described below. Further, the embodiments of the present disclosure are provided to more fully explain the present disclosure to those skilled in the art.

The present inventors have found that regarding a high manganese steel hot-rolled steel sheet, in the case of the microstructure of the steel is secured as austenite at room temperature by adding large amounts of manganese and carbon and the spherical particle size after dynamic and static recrystallization is maintained during hot rolling, strength and formability may be secured, but there is a problem in which fatigue performance is poor due to low resistance to fatigue crack propagation.

In addition, the inventors have found that, in the case of controlling the microstructure to form an unrecrystallized microstructure having high dislocation density by finishing rolling at the temperature equal to or higher than that of a recrystallization temperature zone in hot rolling, the resistance against generation and propagation of fatigue crack increases, but have recognized that there is a problem in which parts cannot be manufactured by cold forming due to inferior formability. Thus, deep research into a solution thereof has been conducted.

Figure 1:
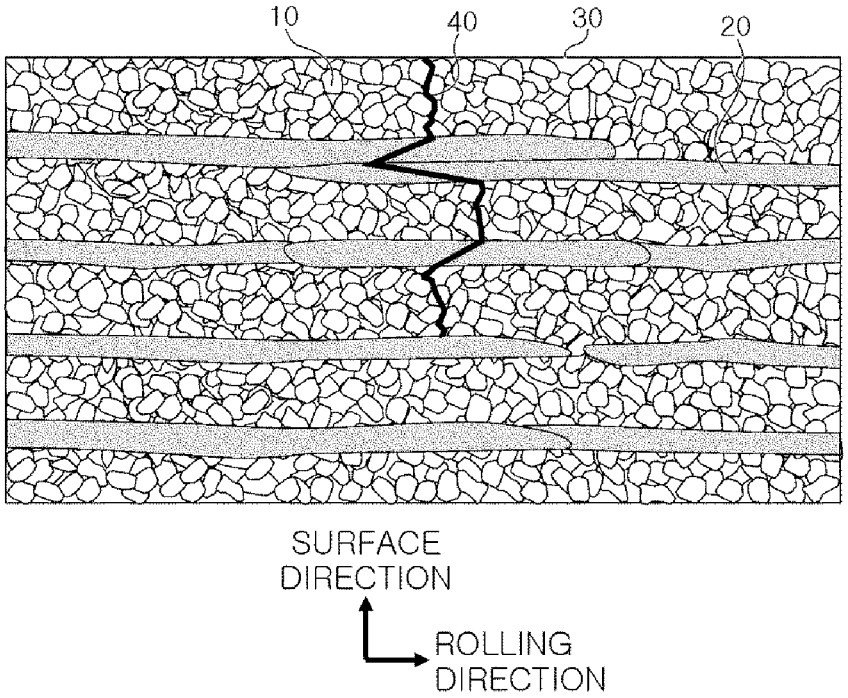
FIG. 1 is a schematic diagram illustrating a microstructure of austenitic high manganese steel to be implemented in an embodiment of the present disclosure.

As a result, a high manganese steel having excellent formability and significantly improved fatigue properties may be obtained by appropriately controlling a element content of the steel composition, performing the function of stabilizing the austenite microstructure, and simultaneously controlling the microstructure to be divided into a sphere-type recrystallized microstructure having excellent formability and an elongated unrecrystallized microstructure having excellent resistance to fatigue crack propagation, as illustrated in FIG. 1.

Hot-Rolled Steel Sheet Having Excellent Formability and Fatigue Properties

Hereinafter, a hot-rolled steel sheet having excellent formability and fatigue properties according to an embodiment of the present disclosure will be described in detail.

The hot-rolled steel sheet having excellent formability and fatigue properties according to an embodiment of the present disclosure includes, by weight %, 0.3 to 0.8% of C, 13 to 25% of Mn, 0.1 to 1.0% of V, 0.005 to 2.0% of Si, 0.01 to 2.5% of Al, not more than 0.03% of P, not more than 0.03% of S, not more than 0.04% (excluding 0%) of N, and a remainder of Fe and unavoidable impurities, and includes, by area fraction, 20 to 70% of an unrecrystallized microstructure and 30 to 80% of a recrystallized microstructure when a cross section in a thickness direction is observed.

First, the alloy composition in an embodiment of the present disclosure will be described in detail. Hereinafter, the unit of each element content means weight % unless otherwise specified.

Carbon (C): 0.3 to 0.8%

Carbon is an element contributing to the stabilization of the austenite phase, and as the content thereof increases, there is an advantage in securing the austenite phase. Carbon also increases the stacking fault energy in the steel, thereby increasing the tensile strength and elongation at the same time. If the content of carbon is less than 0.3%, there is a problem in which the α'-martensite phase is formed on the surface layer due to decarburization at the time of high-temperature processing of the steel sheet, resulting in poor delayed fracture resistance and fatigue performance. Further, in this case, there is a difficulty in securing tensile strength and elongation. On the other hand, if the content thereof exceeds 0.8%, electrical specific resistance may increase and weldability may decrease. Therefore, according to an embodiment in the present disclosure, the carbon content may be controlled to be 0.3 to 0.8%.

Further, the lower limit of the carbon content may be, in detail, 0.4%, and in further detail, 0.5%. Further, the upper limit of the carbon content may be, in detail, 0.75%.

Manganese (Mn): 13 to 25%

Manganese is an element which stabilizes the austenite phase together with carbon. When the content thereof is less than 13%, it is difficult to secure a stable austenite phase due to the formation of α'-martensite phase during deformation. If the content of Mn exceeds 25%, there may be a problem in which the further improvement with respect to the increase of the strength, which is an interest in the present disclosure, does not occur substantially and the manufacturing cost rises. Therefore, the content of Mn in an embodiment may be limited to, in detail, 13 to 25%.

In addition, the lower limit of the manganese content may be, in detail, 14%, and in further detail, 15%. Further, the upper limit of the manganese content may be, in detail, 23%, and in further detail, 21%.

Vanadium (V): 0.1 to 1.0%

Vanadium may be a significantly important element according to an embodiment in the present disclosure, as an element of increasing the recrystallization temperature during hot rolling. Since vanadium tends to be concentrated as a solid phase during solidification and the diffusion rate thereof is slow in the solid phase, the distribution thereof in steel of the solidified structure is considerably maintained even after the reheating process for rolling, and recrystallization behaviors in a portion in which a vanadium concentration is high and in a portion in which the vanadium concentration is low are different during the rolling, thereby implementing a dual microstructure of the recrystallized microstructure and the unrecrystallized microstructure.

If the content of V is less than 0.1%, it is difficult to observe the rolling conditions for implementing the dual microstructure, and thus, microstructure deviation may occur in the steel sheet. On the other hand, if the content of V is more than 1.0%, coarse precipitates are formed at the time of solidification, and even in the case in which the reheating process is carried out, the precipitates may remain in the steel sheet, causing cracking during rolling. Further, even when the content of V is excessive, it may be difficult to observe the rolling conditions to implement the dual microstructure.

Therefore, the content of vanadium according to an embodiment in the present disclosure may be 0.1 to 1.0%. In detail, a lower limit of the vanadium content may be 0.15%, and in more detail, the lower limit of the vanadium content may be 0.2%, and an upper limit of the vanadium content may be 0.9%, and in more detail, may be 0.8, to facilitate the observance of the rolling conditions to implement the dual microstructure.

Silicon (Si): 0.005 to 2.0%

Silicon is a element that may be added to improve the yield strength and tensile strength of steel by solid solution strengthening. Silicon is used as a deoxidizing agent, and thus, may be contained in an amount of 0.005% or more. If the content of silicon exceeds 2.0%, a large amount of silicon oxide is formed on the surface during hot rolling to lower pickling performance. And there may be a problem in which the weldability is lowered due to increasing electrical specific resistance. Therefore, the content of silicon may be limited to 0.005 to 2.0%.

Aluminum (Al): 0.01 to 2.5%

Although aluminum is usually added for the deoxidation of steel, in the case of an embodiment of the present disclosure, aluminum may enhance the ductility and delayed fracture resistance of steel by suppressing the formation of s-martensite by increasing stacking fault energy. If the aluminum content is less than 0.01%, there may be a problem in which the ductility of the steel is deteriorated due to a rapid work hardening phenomenon and the delayed fracture resistance is poor. On the other hand, if the aluminum content exceeds 2.5 wt %, the tensile strength of the steel is lowered, casting properties is lowered, and the surface quality of the steel surface is deteriorated due to an increase in oxidation of the steel surface during hot rolling.

Phosphorus (P): 0.03% or less

The phosphorus is an impurity which is inevitably contained, and is an element that causes a deterioration in the workability of the steel due to segregation. Therefore, the content thereof may be controlled to be as low as possible. Theoretically, it is preferable to limit the phosphorus content to 0%, but the phosphorus is inevitably contained in the manufacturing process. Therefore, it is important to manage the upper limit thereof, and according to an embodiment in the present disclosure, the upper limit of the phosphorus content is controlled to be 0.03%.

Sulfur (S): 0.03% or less

Sulfur is inevitably contained as impurities, which forms a coarse manganese sulfide (MnS) to cause defects such as flange cracks and greatly reduces the hole expandability of the steel sheet. Therefore, the content thereof may be controlled to be as low as possible. Theoretically, the sulfur content may be advantageously limited to 0%, but it is inevitably contained in the manufacturing process. Therefore, it is important to manage the upper limit thereof, and according to an embodiment in the present disclosure, the upper limit of the sulfur content is controlled to be 0.03%.

Nitrogen (N): 0.04% or less (excluding 0%)

Nitrogen (N) reacts with Al in austenite grains during the solidification process to precipitate fine nitrides to promote the generation of twin, thereby improving the strength and ductility of the steel sheet during forming. However, if the content thereof exceeds 0.04%, nitrides are precipitated excessively and the hot workability and elongation may be lowered. Therefore, according to an embodiment in the present disclosure, the nitrogen content may be limited to 0.04% or less.

The remainder of components in the embodiment of the present disclosure is iron (Fe). However, in the ordinary manufacturing process, impurities which are not intended may be inevitably mixed from a raw material or a surrounding environment, which may not be excluded. These impurities are known to those skilled in the art and thus, are not specifically mentioned in this specification.

In addition to the above composition, one or more selected from 0.01 to 0.5% of Ti, 0.05 to 0.5% of Nb, 0.01 to 0.5% of Mo, and 0.0005 to 0.005% of B may be further included in the hot-rolled steel sheet.

Titanium (Ti): 0.01 to 0.5%

The content of titanium (Ti) may be 0.01 to 0.5%. Titanium reacts with nitrogen in the steel to be precipitated as a nitride, which improves the formability of steel in hot rolling. In addition, the titanium reacts with some carbon in steel to form precipitation phases, thereby increasing the strength. To this end, titanium may be contained in an amount of 0.01% or more, but if the titanium content exceeds 0.5%, precipitates are formed excessively to deteriorate fatigue properties of the parts. Accordingly, the titanium content may be 0.01 to 0.5%.

Niobium (Nb): 0.05 to 0.5%

Niobium is an element that reacts with carbon or nitrogen to form a carbonitride, and is an element that may be added to increase the yield strength by refinement of grains and precipitation strengthening. To obtain such an effect, the content of niobium may be 0.05% or more. On the other hand, if the content of niobium exceeds 0.5%, coarse carbonitride may be formed at high temperature, thereby deteriorating hot workability. Therefore, the vanadium content may be 0.05 to 0.5%.

Molybdenum (Mo): 0.01 to 0.5% or less

Molybdenum is also an element that forms carbide. When molybdenum is compounded with a carbonitride-forming element such as titanium, vanadium or the like, molybdenum serves to maintain the size of the precipitate finely to increase the yield strength. To obtain such an effect, the content of molybdenum may be 0.01% or more, but if the content of molybdenum exceeds 0.5%, the effect may be saturated and production costs may be increased. Therefore, the molybdenum content may be 0.01 to 0.5%.

Boron (B): 0.0005 to 0.005%

When boron is added in a small amount, the grain boundary of the slab is strengthened to improve hot rolling properties. However, if the content of boron is less than 0.0005%, the above effect is not sufficiently exhibited. If the content of boron exceeds 0.005%, additional performance improvements may not be expected and costs may be increased. Therefore, the content of boron may be 0.0005 to 0.005%.

The hot-rolled steel sheet according to an embodiment in the present disclosure contains 20 to 70% of an unrecrystallized microstructure and 30 to 80% of a recrystallized microstructure in an area fraction when a cross section is observed in a thickness direction.

Fatigue cracks propagate and grow by the moving of dislocation in the microstructure near the crack tip. Therefore, the crack propagation rate in the unrecrystallized microstructure, in which the dislocation density is already high, may become significantly slower than the rate in the recrystallized microstructure. When the unrecrystallized microstructure is less than 20%, the effect of suppressing the propagation of fatigue cracks is insufficient and the fatigue properties may be lowered. When the unrecrystallized microstructure is more than 70%, a recrystallized microstructure for ensuring the formability may not be sufficiently secured.

The recrystallized microstructure serves to improve the formability of the steel sheet. If the recrystallized microstructure is less than 30%, the elongation of the steel sheet may not be secured, deteriorating the formability. If the recrystallized microstructure is more than 80%, the unrecrystallized microstructure may not be sufficiently secured.

In this case, the unrecrystallized microstructure is in the form of being elongated in the rolling direction, and the aspect ratio thereof is 2 or more, and the recrystallized microstructure may be spherical. A V-concentrated zone having a high non-recrystallization temperature due to the concentration of V remains in the steel sheet in the form of being elongated in the rolling direction by rolling, and a V non-concentrated zone remains as the grain size of a spherical shape in the steel sheet at the same rolling temperature by dynamic and static recrystallization.

In addition, a layer formed of an unrecrystallized microstructure and a layer formed of a recrystallized microstructure may be alternately formed, when observing a cross section in the thickness direction.

In such a form, the unrecrystallized microstructure formed between layers formed of the recrystallized microstructure may more easily suppress crack propagation.

In addition, the microstructure of the hot-rolled steel sheet according to an embodiment in the present disclosure may contain 95% or more of austenite, which is to secure strength and elongation at the same time. In more detail, the microstructure may be an austenite single phase. The austenite single phase means that all the microstructures except carbide are formed of austenite, and may include unavoidable microstructure.

On the other hand, the austenitic high manganese steel according to an embodiment in the present disclosure may have an elongation of 40% or more and a number of cycles to failure (Nf) of 300 MPa or more. Such excellent elongation and fatigue properties may be secured and thus, may be suitably applied to structural members for automobile chassis components and the like.

Method of Manufacturing Hot-Rolled Steel Sheet Having Excellent Formability and Fatigue Properties Hereinafter, a method of manufacturing a hot-rolled steel sheet having excellent formability and fatigue properties according to another embodiment in the present disclosure will be described in detail.

According to another embodiment in the present disclosure, there is provided a method of manufacturing a hot-rolled steel sheet having excellent yield strength and fatigue properties, including: preparing a slab satisfying the above-described alloy composition; heating the slab to 1050 to 1250° C.; finish rolling the heated slab at a temperature of not lower than a recrystallization temperature of a region having an average V concentration and of not higher than a recrystallization temperature of a region having twice the average V concentration, to obtain a hot rolled steel sheet; and coiling the hot-rolled steel sheet at 50 to 700° C.

Preparing for Slab

A slab satisfying the above alloy composition is prepared.

In this case, molten steel may be cast at a cooling rate of 50° C./s or less to cause a difference in V concentration in the slab.

Figure 2A:
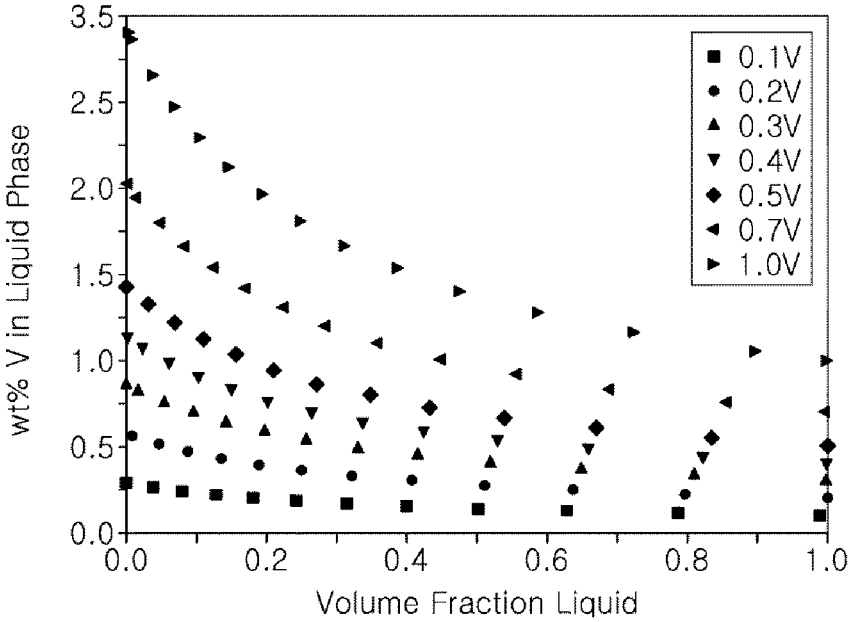
FIG. 2A is a graph illustrating a concentration of vanadium in a liquid phase during solidification depending on an addition amount of vanadium.

FIG. 2A illustrates vanadium concentration in a liquid phase during solidification depending on the addition amount of vanadium. It can be seen that as the fraction of the liquid phase decreases and the fraction of the solid phase increases, the concentration of vanadium in the liquid phase progresses and the concentration of vanadium in the liquid phase immediately before the completion of solidification increases to a level of three times the addition amount.

Figure 2B:
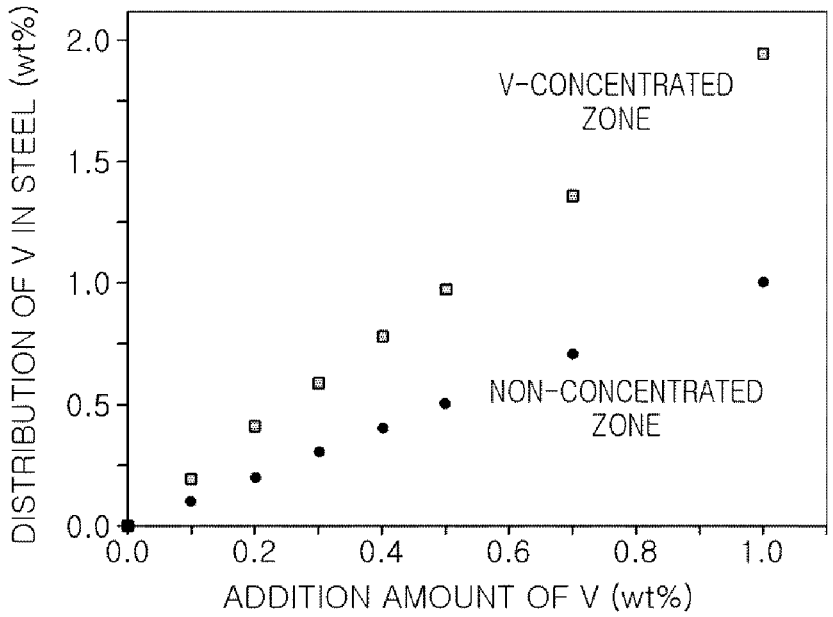
FIG. 2B is a graph illustrating a V concentration in a liquid phase (a V-concentrated zone) and a V concentration in a solid phase (a non-concentrated zone), depending on an addition amount of vanadium at a temperature at which a liquid phase of 20% remains during solidification.

FIG. 2B illustrates the concentration of V in the liquid phase (the V-concentrated zone) and the concentration of V in the solid phase (the non-concentrated zone) at a temperature at which the liquid phase of 20% remains. It can be seen that at 20% of the liquid phase, the V concentration in the solid phase illustrates a V concentration almost similar to the addition amount of V, and a V concentration in the 20% liquid phase which finally solidifies is equal to or more than two times the addition amount of V.

The distribution of the vanadium concentration in the steel is dualized by a difference in the distribution coefficient between the solid phase and the liquid phase generated during solidification, which affects the recrystallization behavior during hot rolling and finally enables a dual microstructure to be implemented. If the cooling rate of molten steel exceeds 50° C./s, diffusion between the solid phase and the liquid phase is not smooth, and the intended concentration distribution may not be obtained. On the other hand, if the cooling rate is low, an element distribution between phases progresses smoothly, and thus, the lower limit of the cooling rate is not particularly limited.

Slab Heating

The slab is heated to 1050 to 1250° C.

If the slab heating temperature is less than 1050° C., it is difficult to ensure the finish rolling temperature during hot rolling, and the rolling load due to the temperature decrease increases, which is problematic in that it is difficult to sufficiently roll to a predetermined thickness. On the other hand, if the slab heating temperature exceeds 1250° C., the grain size increases, surface oxidation occurs, and the strength tends to decrease or the surface tends to be inferior. In addition, since the liquid phase film is formed on the columnar grain boundary of a continuous cast slab, there is a fear that cracks may occur during the subsequent hot rolling.

Hot Rolling

The heated slab is finishing rolled at a temperature not lower than the recrystallization temperature of the region having the average V concentration and not higher than the recrystallization temperature of the region having twice the average V concentration, to obtain a hot rolled steel sheet.

Through the finishing rolling temperature control, a vanadium-concentrated layer is provided to obtain an unrecrystallized rolled microstructure, and a non-concentrated layer is provided to obtain a microstructure in which spherical and recrystallization completed. The reason that the upper limit of the finish rolling temperature is limited to the recrystallization temperature in the region having twice the average V concentration is that the V concentration at the point of 20% of the liquid phase at the final stage of solidification is twice the average V concentration, and thus, 20% or more of unrecrystallized microstructure may be secured in the microstructure of the steel sheet.

Figure 3A:
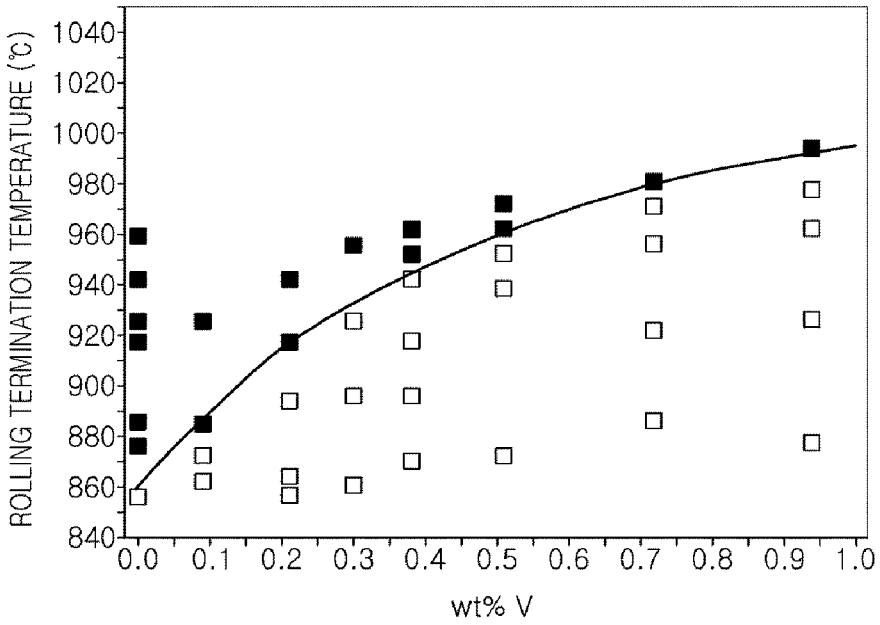
FIG. 3A is a graph illustrating the recrystallization behavior of high Mn steel, depending on an addition amount of vanadium and a rolling termination temperature.

FIG. 3A illustrates the recrystallization behavior of a V-added high Mn steel prepared in the laboratory, depending on a rolling termination temperature. In this case, to prevent the V concentration deviation in the slab from occurring, the ingot was cast using a copper plate mold having a thickness of 40 mm and a width of 160 mm such that a cooling rate of molten steel in the slab casting was 60° C./s or more, and was cooled to room temperature by inserting a water pipe for cooling into the copper plate mold.

Figure 3B:
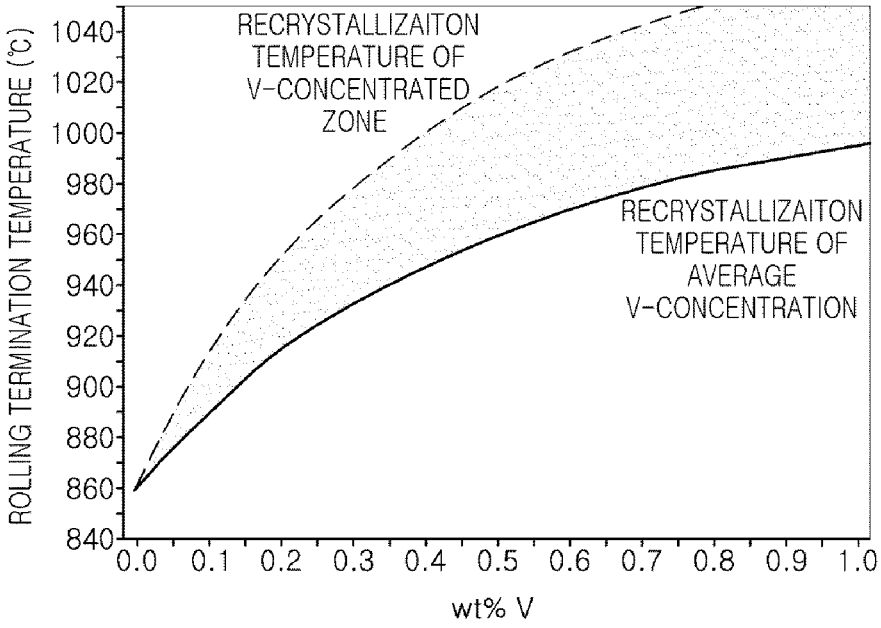
FIG. 3B is a graph illustrating a finishing rolling temperature range depending on a recrystallization temperature in a V-concentrated zone and a non-concentrated zone.

It can be confirmed that the recrystallization temperature is increased sharply by vanadium addition, and that the rate of increase is lowered in the region of 1.0 wt % or more. FIG. 3B illustrates the recrystallization temperature (solid line) of the region having the average V concentration provided by obtaining the recrystallization temperature (dotted line) of the region having twice the average V concentration to obtain the rolling termination temperature, depending on the addition amount of vanadium to implement the dual microstructure.

For example, in the case of a steel to which 0.25 wt % of vanadium is added, the recrystallization temperature of the region having the average V concentration is 920° C., and the recrystallization temperature of the region having twice the average V concentration (the concentrated zone containing 0.5 wt % or more of vanadium and occupying 20% in the area fraction) is 960° C. Therefore, when the finish rolling is performed at a temperature between 920° C. and 960° C., a dual microstructure comprised of an about 80% by area fraction of recrystallized microstructure and an about 20% by area fraction of unrecrystallized microstructure may be obtained. Therefore, by setting the addition amount of vanadium and the finishing rolling temperature, a required microstructure may be easily secured.

Coiling

An operation of coiling the hot-rolled steel sheet at 50 to 700° C. is included.

If the coiling temperature is less than 50° C., cooling by cooling water injection is required to reduce the temperature of the steel sheet, which causes an unnecessary increase in the process cost. On the other hand, if the coiling temperature exceeds 700° C., the dislocation density in the unrecrystallized microstructure decreases due to recovery, deteriorating yield strength of the steel sheet. Therefore, the coiling temperature may be limited to 50 to 700° C.

In this case, an operation of pickling the coiled hot-rolled steel sheet may further be performed, which is to remove an oxide layer.

MODE FOR INVENTION

Hereinafter, an embodiment in the present disclosure will be described in more detail by way of examples. It should be noted, however, that the following examples are intended to illustrate the present disclosure in more detail and not to limit the scope of the present disclosure. The scope of the present disclosure is determined by the matters set forth in the claims and the matters reasonably inferred therefrom.

The slabs having the compositions shown in the following Table 1 were heated to 1200° C., followed by finish rolling at the rolling termination temperature shown in Table 2 below, and coiled at 450° C. to produce hot-rolled steel sheets.

The microstructures of the hot-rolled steel sheets were observed, and the yield strength, tensile strength, elongation and numbers of cycles to failure were measured and the measurement results are shown in Table 2 below.

The microstructure was measured by observing cross sections in a thickness direction by a scanning electron microscope (SEM), and mechanical properties were measured by a universal tensile testing machine.

The number of cycles to failure was measured under the condition of the stress ratio of −1 with the bending fatigue testing machine for Comparative Example 1, Comparative Example 2, and Inventive Example 1, and the number of cycles to failure was set to 10,000,000.

TABLE 1

| Classification | Steel Grade | C | Si | Mn | P | S | Al | Mo | V | Ti | N |
|---|---|---|---|---|---|---|---|---|---|---|---|
| Comparative Steel | A | 0.65 | 0.01 | 17.5 | 0.01 | 0.002 | 1.8 | 0 | 0 | 0 | 0.0003 |
| Inventive Steel | B | 0.60 | 0.01 | 16.5 | 0.01 | 0.002 | 1.3 | 0 | 0.25 | 0 | 0.0003 |
| Inventive Steel | C | 0.72 | 0.70 | 17.0 | 0.01 | 0.002 | 1.2 | 0.3 | 0.3 | 0.06 | 0.0003 |

In Table 1, the unit of each element content is weight %.

TABLE 2

| | | Rolling Termination Temperature | | Microstructure (area %) | | | | | |
|---|---|---|---|---|---|---|---|---|---|
| Classification | Steel Grade | Temperature (° C.) | Whether or not to be satisfied | Recrystallized Microstructure | Non-crystallized Microstructure | Yield Strength (MPa) | Tensile Strength (MPa) | Elongation (%) | number of cycles to failure (MPa) |
| Comparative Example 1 | A | 941 | X | 98 | 2 | 442 | 892 | 72 | 262 |

TABLE 2-continued

| Classification | Steel Grade | Rolling Termination Temperature: Temperature (° C.) | Rolling Termination Temperature: Whether or not to be satisfied | Microstructure (area %): Recrystallized Microstructure | Microstructure (area %): Non-crystallized Microstructure | Yield Strength (MPa) | Tensile Strength (MPa) | Elongation (%) | number of cycles to failure (MPa) |
|---|---|---|---|---|---|---|---|---|---|
| Comparative Example 2 | B | 881 | X | 18 | 82 | 681 | 1058 | 38 | 405 |
| Inventive Example 1 | | 933 | ○ | 54 | 46 | 612 | 1043 | 51 | 360 |
| Comparative Example 3 | | 972 | X | 97 | 3 | 502 | 986 | 42 | — |
| Inventive Example 2 | C | 945 | ○ | 52 | 48 | 647 | 1048 | 48 | — |
| Comparative Example 4 | | 980 | X | 85 | 15 | 492 | 973 | 71 | — |
| Comparative Example 5 | | 1019 | X | 96 | 4 | 446 | 952 | 75 | — |

'Whether or not to be satisfied' in Table 2 indicates whether or not the finish rolling was performed at a temperature equal to or higher than the recrystallization temperature of the region having the average V concentration of each steel grade and equal to or lower than the recrystallization temperature of the region having twice the average V concentration of each steel grade. O is marked for satisfactory results, and X is marked for unsatisfactory results.

In the case of Inventive Examples 1 and 2, which satisfy both the composition and the manufacturing conditions of the present disclosure, it can be confirmed that the area fraction of the unrecrystallized microstructure satisfies 20% or more and an elongation of 40% or more may be secured.

Meanwhile, in Comparative Example 1, the composition according to an embodiment in the present disclosure was not satisfied, and an unrecrystallized microstructure of 20% or more in area fraction could not be secured, and fatigue performance was poor.

In Comparative Example 2, the composition according to an embodiment in the present disclosure was satisfied, but the production conditions were not satisfied, and a spherical recrystallized microstructure exceeding 30% in area fraction could not be secured, and thus an elongation of 40% or more could not be secured.

In Comparative Examples 3 to 5, the composition according to an embodiment in the present disclosure was satisfied, but the production conditions were not satisfied and an unrecrystallized microstructure of 20% or more in the area fraction could not be secured.

FIG. 1 is a schematic diagram of a microstructure to be implemented in the present disclosure. An unrecrystallized microstructure 20 elongated in a rolling direction in parallel with a surface 30 is located in a spherical recrystallized microstructure 10, and a fatigue crack 40 is difficult to propagate in the unrecrystallized microstructure, which exhibits excellent resistance to fatigue crack propagation.

FIG. 4 provides images of microstructures of Comparative Example 1, Comparative Example 2 and Inventive Example 1, captured by a scanning electron microscope. FIG. 4A is a value obtained by measuring Kernal Average Misorientation (KAM) of Comparative Example 1, and FIG. 4B illustrates the shape of each microstructure with the Image Quality (IQ) Map of the same region. FIG. 4C is a value obtained by measuring the KAM of Comparative Example 2, and FIG. 4D is an IQ Map of the same region. FIG. 4E is a value obtained by measuring the KAM of Inventive Example 1, and FIG. 4F is an IQ map of the same region. KAM is expressed in color, and the part expressed in blue in KAM is a recrystallized microstructure. The regions represented by green, yellow, orange, and red is unrecrystallized microstructures having a high dislocation density. When the KAM is converted to monochrome as illustrated in FIGS. 4A, 4C and 4E, since blue is the darkest color, the region represented by the darkest color is the region in which the recrystallization is completed, and the region represented by the relatively bright color is an unrecrystallized microstructure in which a dislocation density is high.

Figure 4A:
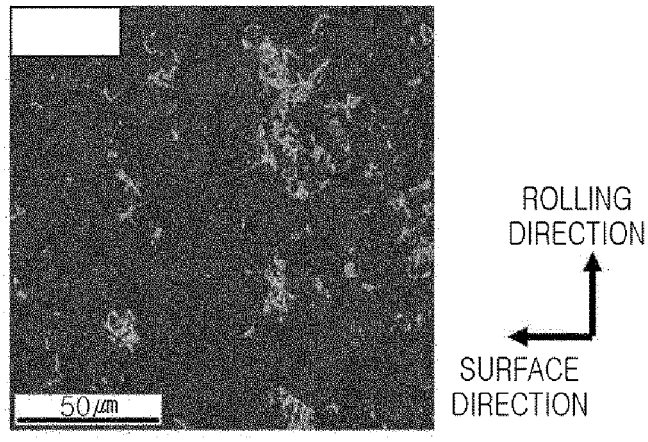
FIGS. 4A and 4B are a scanning electron microscope (SEM) images, illustrating a microstructure of Comparative Example 1.
Figure 4B:
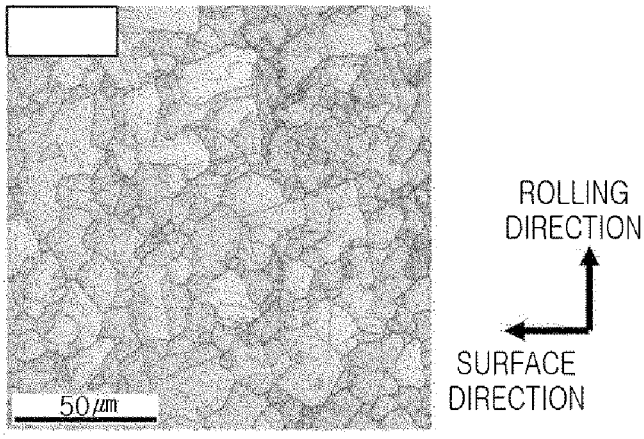
Figure 4C:
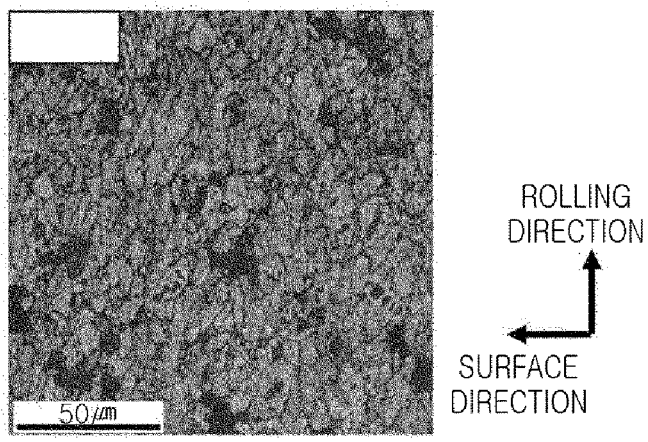
FIGS. 4C and 4D are SEM images illustrating Comparative Example 2.
Figure 4D:
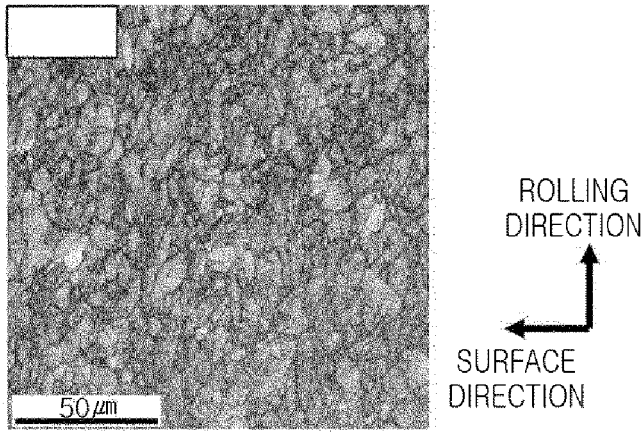
Figure 4E:
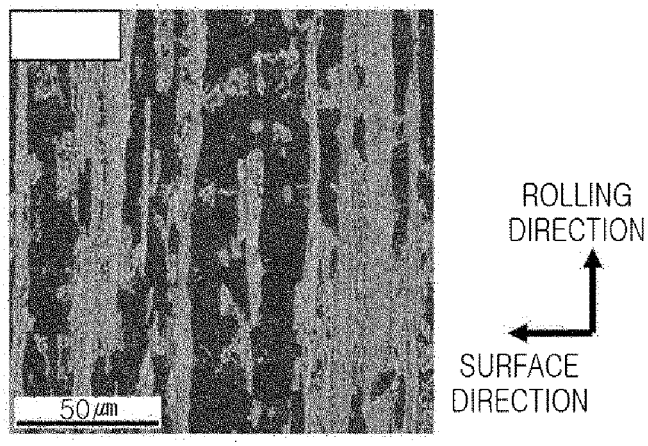
FIGS. 4E and 4F are SEM images illustrating a microstructure of Inventive Example 1.
Figure 4F:
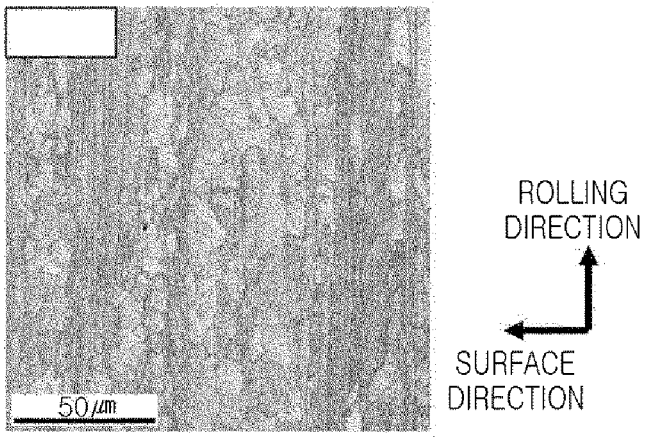

As can be seen from FIGS. 4A and 4B, the microstructure of Comparative Example 1 mostly retains the spherical granular phase having been recrystallized. As can be seen from FIGS. 4C and 4D, the microstructure of Comparative Example 2 is mostly composed of an unrecrystallized microstructure having a high dislocation density. As can be seen from FIGS. 4E and 4F, in the case of the microstructure of Inventive Example 1, the unrecrystallized microstructure of 46% by area fraction, in the form of elongated in the rolling direction, is present between spherical recrystallized microstructures.

FIG. 5 is a scanning electron microscope image illustrating the microstructure of Inventive Example 2.

Figure 5A:
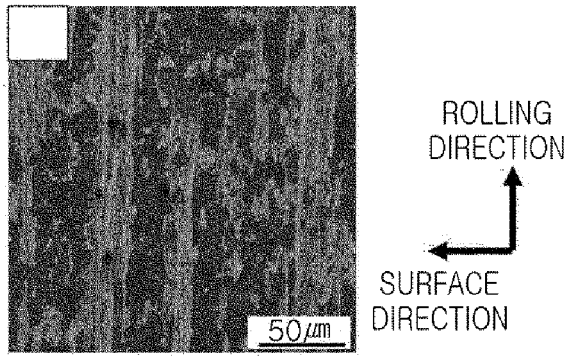
FIGS. 5A and 5B are SEM images of microstructures of Inventive Example 2.

FIG. 5A is a value obtained by measuring Kernal Average Misorientation (KAM). KAM is expressed in color, and the part expressed in blue in KAM is a recrystallized microstructure. The regions represented by green, yellow, orange, and red are unrecrystallized microstructures having a high dislocation density. When the KAM is converted to monochrome as illustrated in FIG. 5A, blue is represented as the darkest color. In this case, the region represented by the darkest color is a microstructure in which the recrystallization is completed, and a region represented by a relatively bright color is an unrecrystallized microstructure in which a dislocation density is high.

Figure 5B:
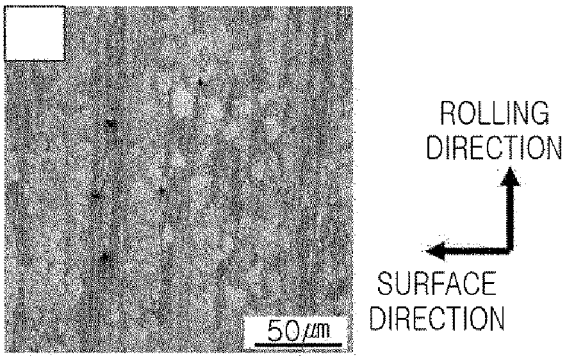
Figure 5C:
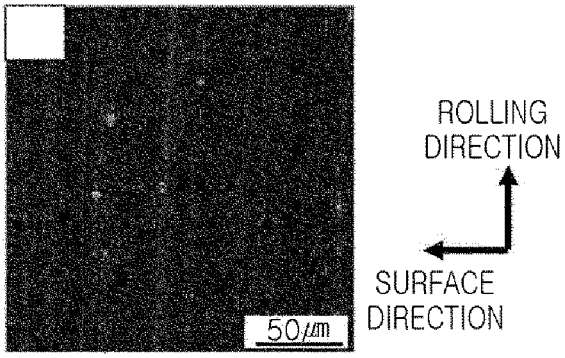
FIG. 5C is an SEM image illustrating a vanadium component distribution in Inventive Example 2.

FIG. 5B illustrates the shape of each microstructure with the Image Quality Map (IQ) of the same region. The recrystallized microstructure is a spherical shape having an aspect ratio of 2 or less, and the unrecrystallized microstructure has the form elongated in a rolling direction at an aspect ratio of 2 or more. FIG. 5C illustrates the vanadium distribution in the same region, and it can be confirmed that the vanadium concentration in the unrecrystallized region is higher than that in the spherical microstructure in which the recrystallization is completed.

Figure 6:
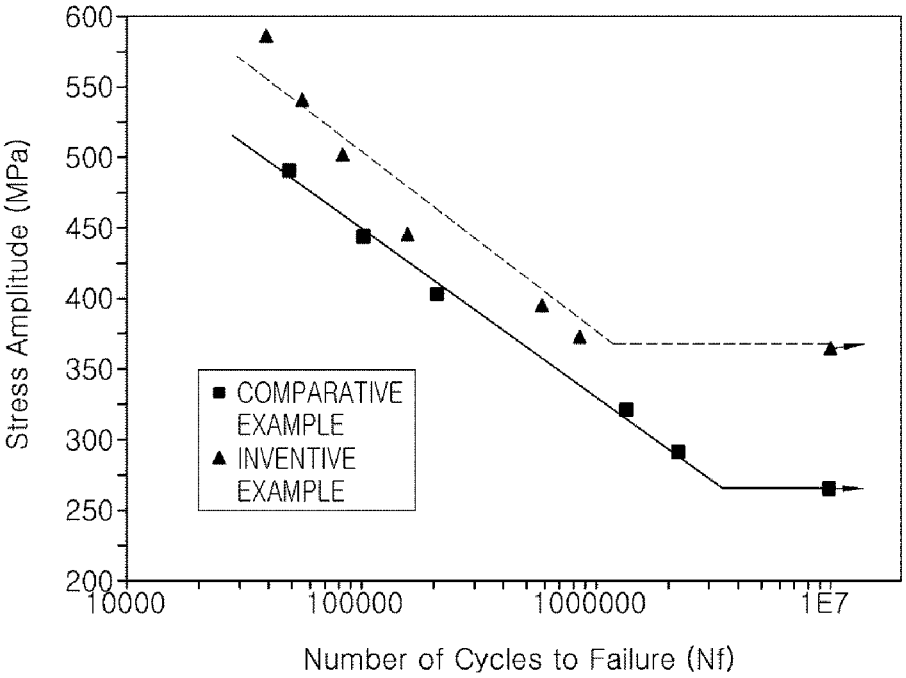
FIG. 6 is a graph illustrating fatigue test results of Inventive Example 1 and Comparative Example 1.

FIG. 6 illustrates the results of measurement of high cycle fatigue properties of Comparative Example 1 and Inventive Example 1. In the case of Inventive Example 1 having a high yield strength due to a high unrecrystallized area fraction in the steel sheet, excellent fatigue properties may be secured in the same stress amplitude, as compared with that in Comparative Example 1, and it could be confirmed that the number of cycles to failure (Nf) was increased about 100 Mpa, because even in the case in which some micro cracks were generated, resistance to crack propagation was excellent and thus, cracks were not increased to fatigue failure.

While embodiments have been illustrated and described above, it will be apparent to those skilled in the art that modifications and variations could be made without departing from the scope of the present disclosure as defined by the appended claims.

The invention claimed is:

1. A method of manufacturing a hot rolled steel sheet, the method comprising:

preparing a slab including, by weight %, 0.3 to 0.8% of carbon C, 13 to 25% of manganese (Mn), 0.1 to 1.0% of vanadium (V), 0.005 to 2.0% of silicon (Si), 0.01 to 2.5% of aluminum (Al), 0.03% or less of phosphorus (P), 0.03% or less of sulfur (S), 0.04% or less (excluding 0%) of nitrogen (N), and a remainder of iron (Fe) and inevitable impurities;

heating the slab to 1050 to 1250° C.;

finish rolling the slab heated in the heating, at a temperature of not lower than a recrystallization temperature of a region having an average V concentration and not higher than a recrystallization temperature of a region having twice the average V concentration, to obtain a hot rolled steel sheet; and coiling the hot-rolled steel sheet at 50 to 700° C., wherein the preparing of the slab is performed by casting a molten steel at a cooling rate of 50° C./s or less to produce a difference in V concentration in the slab.

2. The method of claim 1, wherein the slab further comprises, by weight %, one or more selected from 0.01 to 0.5% of Ti, 0.05 to 0.5% of Nb, 0.01 to 0.5% of Mo, and 0.0005 to 0.005% of B.

3. The method of claim 1, further comprising pickling the hot-rolled steel sheet coiled in the coiling.

* * * * *